United States Patent [19]

Nubson et al.

[11] Patent Number: 4,921,237

[45] Date of Patent: May 1, 1990

[54] INPUT HOPPER APPARATUS AND METHOD

[75] Inventors: Richard C. Nubson, Eden Prairie; Gary P. Mattila, St. Louis Park, both of Minn.

[73] Assignee: DataCard Corporation, Minneapolis, Minn.

[21] Appl. No.: 256,091

[22] Filed: Oct. 7, 1988

Related U.S. Application Data

[63] Continuation of Ser. No. 904,053, Sep. 5, 1987, abandoned.

[51] Int. Cl.[5] ..... B65H 3/08

[52] U.S. Cl. ..... 271/11; 271/31.1; 271/104; 271/105; 271/106; 271/161

[58] Field of Search ..... 271/11–13, 271/99, 102, 104, 105, 106, 31.1, 161

[56] References Cited

U.S. PATENT DOCUMENTS

| | | | |
|---|---|---|---|
| 696,186 | 3/1902 | Orloff | 271/106 X |
| 770,696 | 9/1904 | Peters | 271/102 X |
| 1,129,456 | 2/1915 | Conradi | 271/102 |
| 1,147,308 | 7/1915 | Caylor | 271/102 |
| 1,787,077 | 12/1930 | Kruse | 271/102 |
| 2,223,391 | 12/1940 | Schweizer | 271/31.1 X |
| 2,378,306 | 6/1945 | Leonhart | 271/166 X |
| 2,643,120 | 6/1953 | Jackson | 271/102 |
| 3,240,488 | 3/1966 | Lyman | 271/149 |
| 3,527,367 | 9/1970 | Bivans | 271/102 X |
| 3,627,308 | 12/1971 | Stoever | 271/104 |
| 3,871,640 | 3/1975 | Ritzerfeld | 271/160 X |
| 4,519,600 | 5/1985 | Warwick et al. | 271/4 |
| 4,548,396 | 10/1985 | Nelen | 271/90 |
| 4,592,542 | 6/1986 | Selak | 271/106 X |
| 4,662,623 | 5/1987 | Nakanishi | 271/160 X |

*Primary Examiner*—Richard A. Schacher

*Attorney, Agent, or Firm*—Merchant, Gould, Smith, Edell, Welter & Schmidt

[57] ABSTRACT

An input hopper apparatus (40) including input hopper receptacle (42) for receiving a stack of cards (44). A pick mechanism (60) is disposed proximate a second end of the input hopper receptacle (42) for individually picking a card from the stack of cards (44) by use of a suction cup assembly (62). A transfer mechanism (70) is included for transferring the picked card to a card transfer path (59).

18 Claims, 8 Drawing Sheets

INPUT HOPPER APPARATUS AND METHOD

This is a continuation of application Ser. No. 904,053 filed Sept. 5, 1987, now abandoned.

BACKGROUND OF THE INVENTION

The present invention relates to an input hopper apparatus and method for feeding cards into a card transfer path More particularly, the present invention relates to an input hopper apparatus utilizing suction means for individually picking a card from a stack of cards and transferring the card to a transfer position in the card transfer path.

The present invention has particular utility with automatic embossing systems such as disclosed in U.S. Pat. Nos. Re. 27,809, 3,820,455, 4,271,012, 4,180,338, 4,088,216, and 4,519,600. Various ones of these patents are high speed systems of substantial size and expense ideally suited for high volume production of credit cards, where as other ones of these patent are particularly suited to low volume production. The automatic embossing systems typically have a number of stations, also referred to as modules, wherein embossing and other functions are performed. The cards are transferred along a path of travel, typically referred to as a card transfer path, between the various stations from an input hopper apparatus which provides a source of cards and an output hopper apparatus wherein the embossed cards are collected.

One type of input hopper apparatus currently being used is often referred to as a knife edge pick cam. In this type of design, a picker cam rotates a knife edge so as to contact the leading edge of a card, forcing it against a backstop, causing the card to bow by buckling. As the card is bowed, a shear stress is created between the first and second cards, causing the card to separate from the first card. As the picker cam continues rotating, the first card slips off the knife edge and straightens out, forcing its leading edge into a set of drive rollers.

Another type of input hopper apparatus uses a knife edge and throat gap. In this method, a knife edge shears one card from the next and forces it through a throat gap such that it is adjusted to allow only one card at a time through the throat.

Some problems which can occur with the above designs are that the knife edge may occasionally pick up two cards or entirely miss picking up a card if not properly adjusted according to the thickness of the cards. In addition, the knife edge can cause damage to the edges of the cards. In addition, there are other problems such as jamming of the input hopper apparatus, which can occur if the input hopper apparatus is not properly adjusted.

The present invention provides an input hopper apparatus and method using suction force for feeding cards into a card transfer path which offers substantial advantages over the input hopper apparatus utilized in the above-referenced patents. Suction force created by a partial vacuum has been used in other applications such as handling large plastic sheets from which smaller plastic cards are made and large paper sheets in printing processes. These devices do not suggest or teach the present invention. In addition to other differences, these applications typically use suction pumps for creating a partial vacuum and are more complex in nature.

SUMMARY OF THE INVENTION

The present invention relates to an input hopper apparatus for receiving a stack of cards and for individually feeding the cards into a card transfer path, each of the cards in the stack of cards being vertically aligned and resting on an edge thereof, the stack of cards having a top, a bottom, front and back ends, and leading and trailing sides. The input hopper apparatus includes an input hopper receptacle means having front and back ends for receiving the stack of cards. The input hopper receptacle means includes a hopper plate supporting the bottom of the stack of cards, guide rail means for guiding movement of such cards on the hopper plate, and means biasing movement of the stack of cards in a backward direction. Pick means is disposed proximate the back end of the hopper receptacle means for individually picking a card from the stack of cards and placing the card in a staged position for subsequent transfer to the card transfer path. The pick means includes suction means reciprocally movable toward the back end of the hopper receptacle means for engaging and removing an individual one of the cards from the back end of the input hopper receptacle means, and a suction release means for releasing the suction means from the card so removed from the input hopper receptacle means, whereby the card is disposed in a staged position upon release of the suction means. The input hopper apparatus further includes transfer means for transferring the card from the staged position to a transfer position in the card transfer path.

Additionally, the present invention relates to a method for receiving a stack of cards and for individually feeding the cards into a card transfer path, each of the cards in the stack of cards being vertically aligned and resting on an edge thereof, the stack of cards having a top, a bottom, front and back ends, and leading and trailing sides. The method comprises the step of receiving a stack of cards in input hopper receptacle means, guiding the stack of cards, and biasing the stack of cards in a backward direction. The method further includes the step of individually picking a card from the stack of cards using suction means reciprocally movable toward the back end of the hopper receptacle means and placing the card so removed in a staged position. The method subsequently includes the step of transferring the card from the staged position to a transfer position in the card transfer path.

It is an object of this invention to provide an input hopper apparatus and method which reliably feeds cards from a stack of cards to a card transfer path.

Yet another object of the invention is to provide an input hopper apparatus and method which is relatively insensitive to the longitudinal positioning of cards fed from an input hopper receptacle.

A further object of the invention is to provide an input hopper apparatus which is relatively insensitive to variations in the card stock thickness. In accordance with this, it is an object of the invention to provide an input hopper apparatus wherein no or minimal adjustments are required for changes in card stock thickness.

Another object of the present invention is to provide an input hopper apparatus which is less likely to damage the cards and card edges.

A further object of the invention is to provide an input hopper apparatus which is largely insensitive to card edge conditions.

Still another object is to provide an input hopper apparatus which is less sensitive to variations in card length.

Still another object of the present invention is to provide an input hopper apparatus which is relatively insensitive to bowed conditions of a card.

Another object of the present invention is to provide an input hopper apparatus which requires a minimal amount of force to separate cards.

An object of a preferred embodiment of the present invention is to provide a suction assembly which does not utilize vacuum pumps or the like, thereby simplifying operation.

Still another object of one embodiment of the present invention is to provide an input hopper apparatus and method which is of relatively low cost, and yet highly efficient and effective in operation.

It will be appreciated that the present invention has particular utility with automatic embossing apparatus utilized in the production of credit cards or in embossing of other media in a fully automated manner.

These and various other advantages and features of novelty which characterize the invention are pointed out with particularity in the claims annexed hereto and forming a part hereof. However, for a better understanding of the invention, its advantages and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF A PREFERRED EMBODIMENT (Throughout the description, the input hopper apparatus will be described in a horizontal orientation. It will be appreciated that the input hopper apparatus may take on other orientations and arrangement of parts and yet be in keeping with the principles of the invention.)

Figure 1:
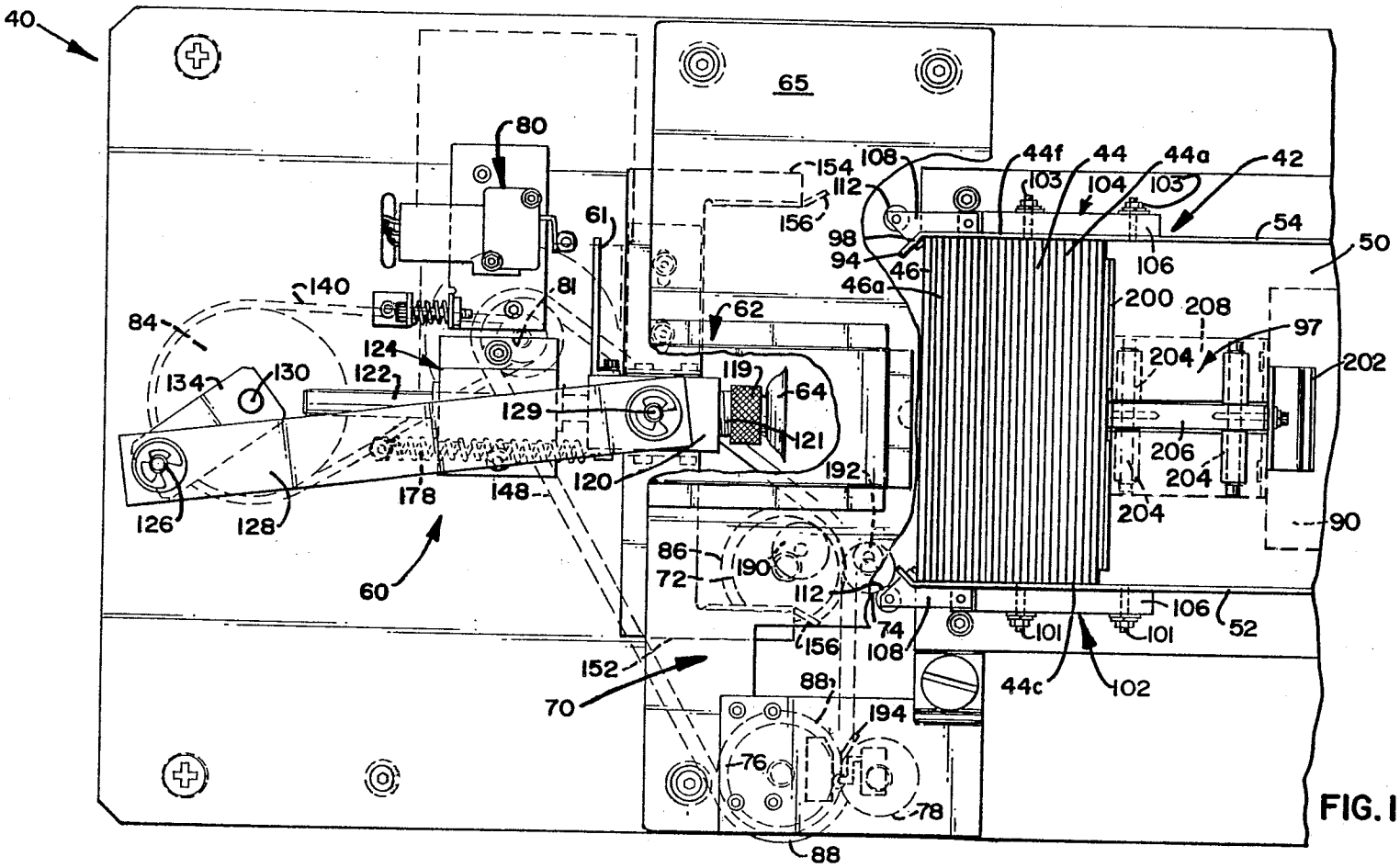
FIG. 1 is a top plan view of an embodiment of an input hopper apparatus in accordance with the principles of the present invention.
Figure 2:
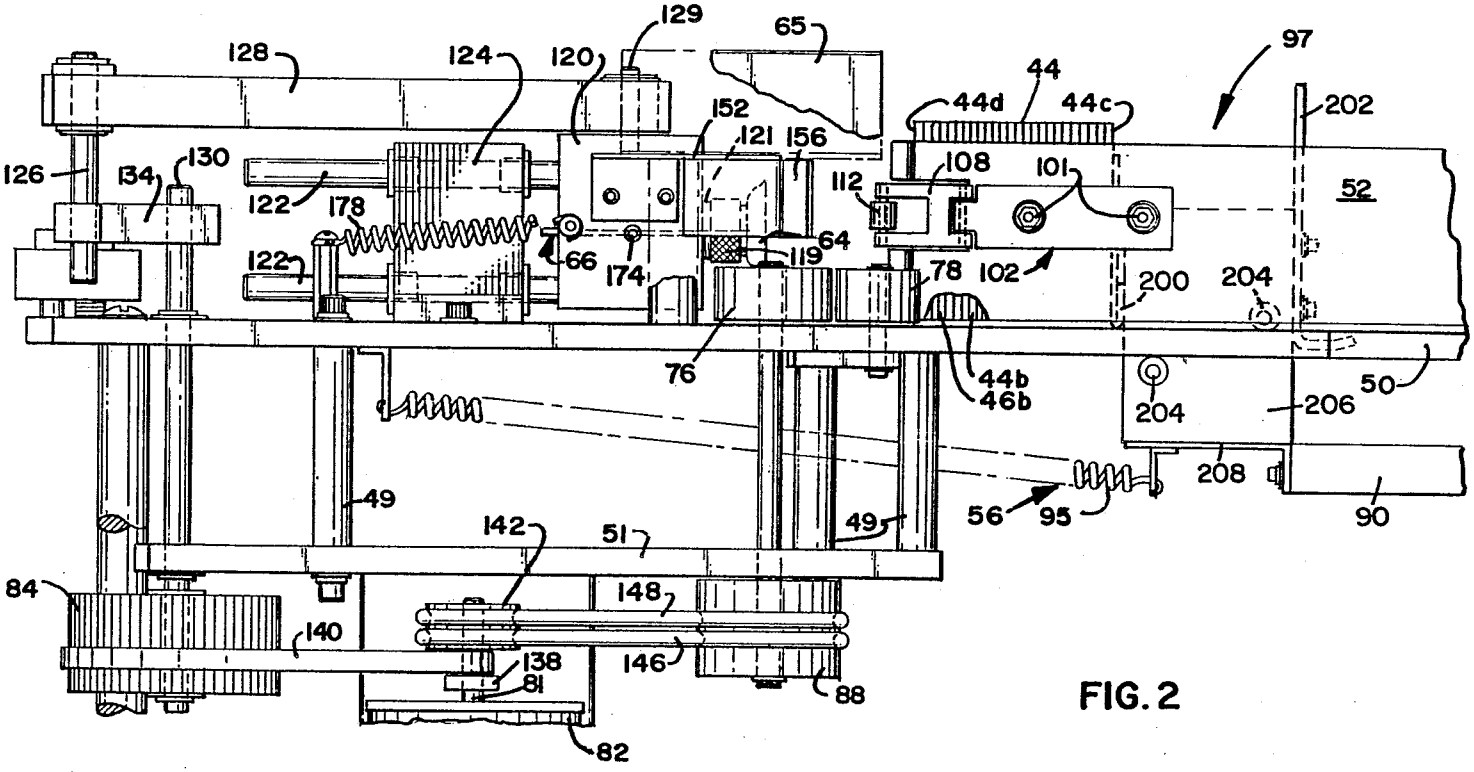
FIG. 2 is a side elevational view of the embodiment shown in FIG. 1 and further illustrating and embodiment of a drive arrangement.
Figure 3:
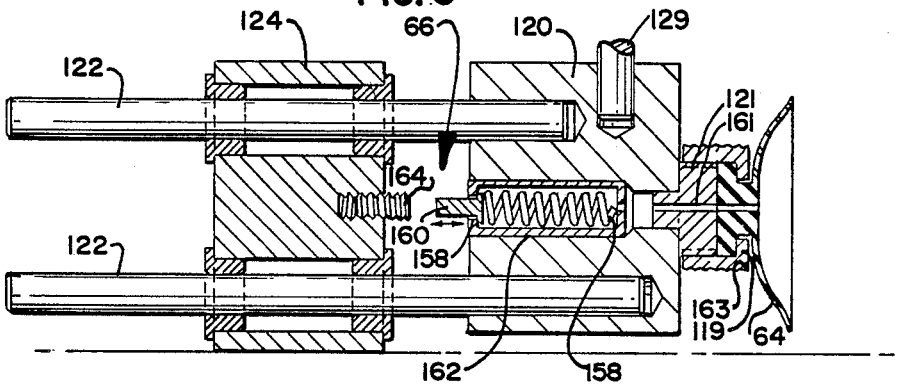
FIG. 3 is an enlarged sectional view of a suction cup and release valve embodiment utilized in the embodiment shown in FIG. 1.
Figure 4:
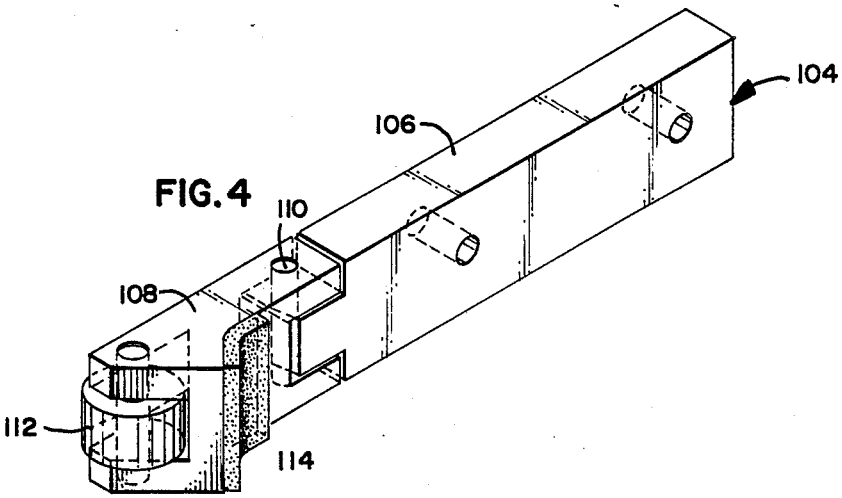
FIG. 4 is a perspective of an embodiment of a card pinch apparatus utilized in the embodiment shown in FIG. 1.
Figure 10:
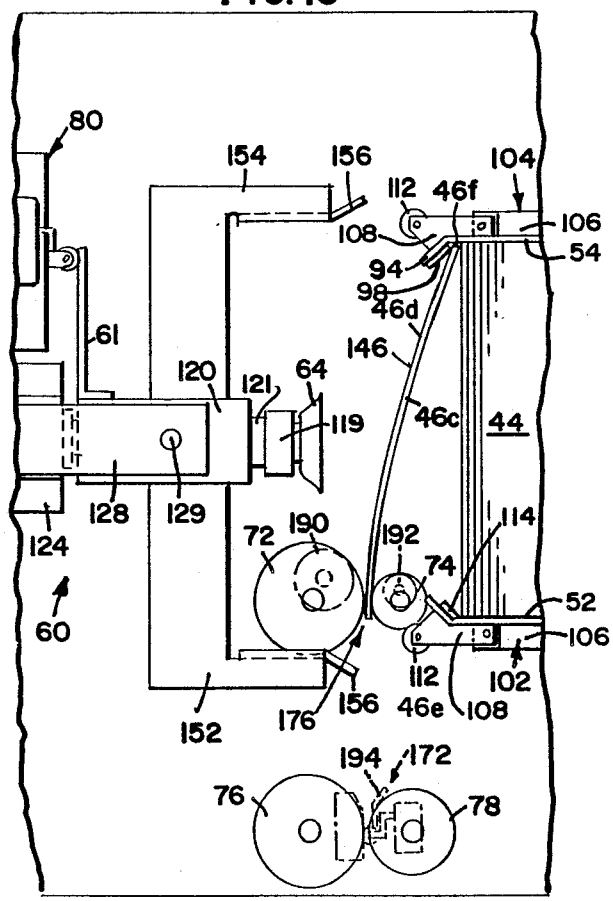
FIG. 10 is a top plan diagrammatic view of the input hopper apparatus in a card staging state of operation.
Figure 11:
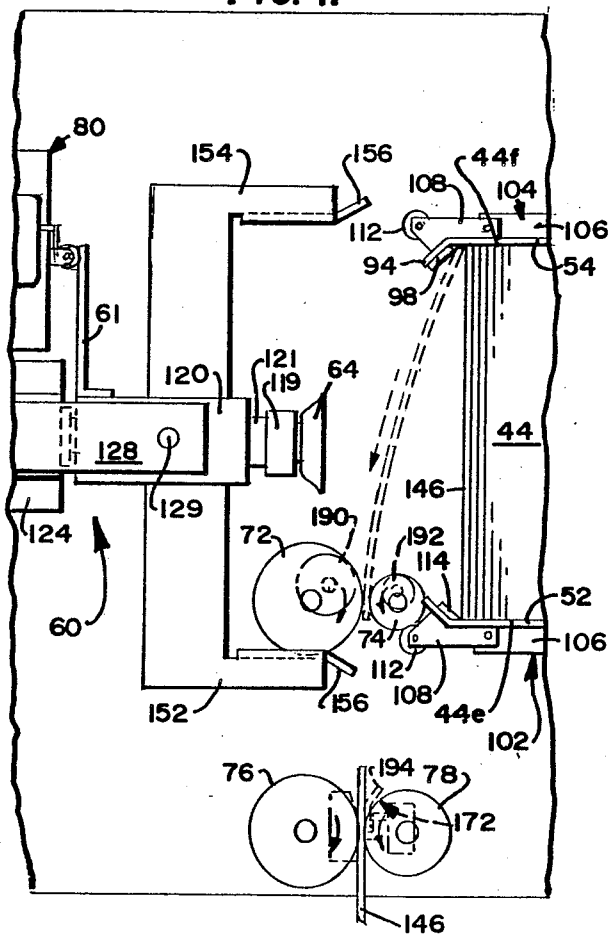
FIG. 11 is a diagrammatic top plan view of the input hopper apparatus in a card transfer state of operation.

Referring now to the figures, there is illustrated in FIGS. 1 through 4, a preferred embodiment of an input hopper apparatus generally in accordance with the principles of the present invention, the input hopper apparatus generally being referred to by the reference numeral 40. Shown positioned in an input hopper receptacle 42 of the input hopper apparatus 40 is a stack of cards 44 comprising individual cards vertically aligned and resting on an edge thereof. The stack of cards 44 is defined as having a top 44*a*, a bottom 44*b*, front and back ends 44*c,d*, and leading and trailing sides 44*e,f*. A last card 46 at the back end 44*d* of the stack of cards 44 is defined as having a top 46*a*, a bottom 46*b*, front and back surfaces 46*c,d* and leading and trailing sides 46*e,f*. The input hopper receptacle includes a support plate member 50 on which the bottom 44*b* of the stack of cards 44 rests. In addition, spaced apart, parallel right and left guide rail members 52,54 are present for guiding movement of the stack of cards 44 on the hopper plate 50. The right and left guide rail members are also referred to as leading and trailing guide rail members, respectively. In the preferred embodiment shown, a biasing arrangement 56 is provided for biasing the stack of cards 44 in a backward direction. A pick arrangement 60 is disclosed proximate the back end of the hopper receptacle 42 for individually picking cards from the stack of cards 44 and placing them in a staged position as generally illustrated in FIG. 10 for subsequent transfer to a card transfer position in a card transfer path 59. In the embodiment illustrated, the pick arrangement 60 includes a suction cup assembly 62 including a flexible rubber suction cup member 64 reciprocally mounted for movement toward and away from the card 46 at the back end 44*d* of the stack of cards 44. In the preferred embodiment, the suction cup assembly 62 provides a natural vacuum; i.e., it does not require the use of any vacuum pumps to create a vacuum which provides the suction force. As illustrated in FIG. 1, at least a portion of the suction cup assembly is enclosed by a cover 65, a portion of the cover 65 being broken away in FIG. 1 for purposes of illustration. The suction cup assembly 62 includes a suction release valve 66 for releasing the suction cup assembly 62 from the card 46 after it has been removed from the input hopper receptacle 42 by the suction cup assembly 62, whereby the card 46 is disposed in the staged position proximate the back end of the input hopper receptacle 42 as generally illustrated in FIG. 10. A transfer mechanism 70 transfers the card 46 from the staged position to a transfer position in a card transfer path 59 as generally illustrated in FIG. 11. The transfer mechanism 70 comprises a plurality of rollers 72,74,76,78 which cooperate in pairs to transfer the card 46 into the transfer position. The pick mechanism 60 is deactivated by a switch 80 which, in turn, is activated by the reciprocal movement of a lever 61 of the pick mechanism 60. As illustrated in the preferred embodiment, a single electric DC motor 82 is used to power both the pick mechanism 60 and the transfer mechanism 70. The DC motor 82 is interconnected to the pick mechanism 60 and the transfer mechanism 70 by one-way pulley/clutch drive arrangements 84,86,88, which enable separate operation of the pick mechanism 60 and the transfer mechanism 70 by reversal of the DC motor rotational movement. In yet other embodiments, the pick mechanism 60 might be driven by one motor and the transfer mechanism 70 by a second motor. In some embodiments, stepper motor arrangements might be used. It will be appreciated that any number of drive arrangements might be used in keeping with the principles of the invention.

Figure 12:
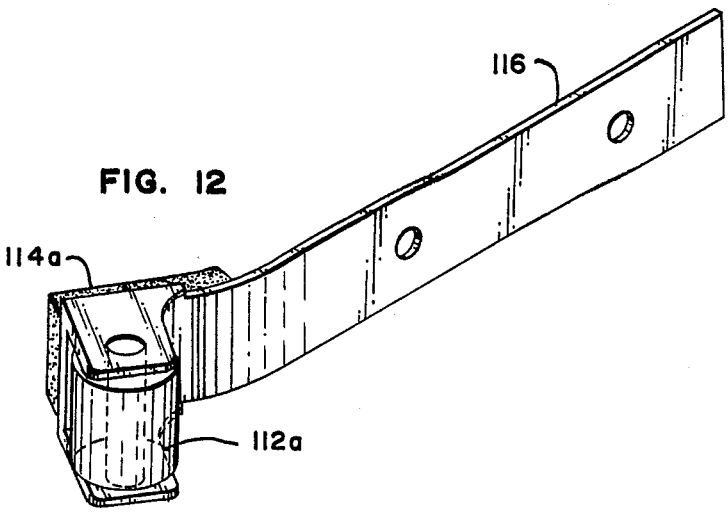
FIG. 12 is a perspective view of an alternate embodiment of a card pinch apparatus.

More particularly, in the preferred embodiment illustrated, the back end of the guide rail members 52,54 include bifurcated end portions 92,94 projecting inwardly toward the stack of cards 44 so as to restrict movement of the stack of cards 44 in the backward direction beyond a predetermined location. The stack of cards 44 as previously mentioned is biased in the backward direction by the biasing arrangement 56. In the embodiment shown, the biasing arrangement 56 includes a coil spring 95 fixedly interconnected proximate a back end to a stationary bracket 96 and proximate a front end to a mass 90 interconnected to a card pusher plate assembly 97 reciprocally mounted on the plate 50. In the preferred embodiment, the biasing arrangement provides a variable force which decreases as the card pusher plate assembly 97 moves closer to the back end of the input hopper receptacle 42. In one embodiment of the invention, the mass 90/card pusher plate assembly 97 has a weight of roughly 1.5 pounds. Preferably, the combined weight will be 1.2 to 1.7 pounds. The left end portion 94 includes a soft resilient material 98 on an inner surface thereof for providing greater resistance to movement of the trailing side 44*f* of the cards in the backward direction than the resistance exerted by the end portion 92 on the leading side 44*e*. Fixedly attached by fasteners 101,103 to the sides of the guide rail members 52,54 proximate the back end thereof are two card pinch members 102,104. In the embodiment shown in FIG. 4, the card pinch members 102,104 include an elongated rigid portion 106 fixedly interconnected to the guide rails 52,54 and a front portion 108 whereby the front portion 108 is pivotal about a shaft 110. Rotatably mounted on the front portion 108 is a roller member 112. Positioned on an inwardly facing surface of the front portion 108 of the card pinch members 102,104 is a soft resilient material 114. The card pinch members 102,104 are configured and arranged so as to enable the front portion 108 thereof to extend through a slot 91,93 (slot 93 not shown) defined by the bifurcated end portions 92,94, respectively. The card pinch members 102,104 are biased outward into a rest or normal position by the sides 44*e,f* of the stack of cards 44 when the input hopper apparatus is not picking cards, wherein the card pinch members 102,104 do not project into the area defined between the guide rail members 52,54. Illustrated in FIG. 12 is an alternate embodiment of the card pinch members 102,104, generally represented by the reference numeral 116. The card pinch member 116 is a resilient one-piece member resiliently biased into a rest position.

The suction cup 64 of the suction cup assembly 62 is threadably mounted on a suction cup block member 120 by cooperating threaded members 119,121, a base portion 64*a* of the suction cup 64 being interconnected to the threaded member 119. The suction cup mounting block 120 is, in turn, fixedly attached to slide members 122 which are slidably mounted in a stationary bearing block 124. The suction cup block member 120 is further interconnected to a drive arm 126 by a linkage member 128, the linkage member 128 being pivotally interconnected to the block member 120 by a shaft 129 and the drive arm 126. The drive arm 126 is, in turn, rotatably driven by a rotatable shaft 130 so as to cause reciprocal movement of the suction block 120. The drive arm 126 is fixedly attached to the rotatable shaft 130 by an extension member 134. The rotatable shaft 130 is, in turn, interconnected to a drive shaft 81 of the DC drive motor 82 by the one-way pulley/clutch 84 in cooperation with a pulley 138 and drive belt 140 arrangement. In addition, the drive shaft 81 of the DC motor is interconnected to the rollers 72,76 by the one-way pulley/-clutches 86,88 in cooperation with a pulley 142 and drive belts 146,148. In the embodiment shown, the input hopper support structure includes a second plate 51 separated from the plate 50 by spacers 49. Rollers 74,78 are spring biased into engagement with the rollers 72,76, respectively, so as to rotate therewith.

Mounted on the leading and trailing sides 150,151 of the suction cup block member 120 are two card pinch activation members 152,154. The card pinch activation members 152,154 are configured and arranged to cooperate with the card pinch members 102,104 such that upon moving the suction cup block member 120 into a forward position, the pinch activation members 152,154 engage the rollers 112 of the card pinch members 102,104 thereby forcing the card pinch members 102,104 into the area of the input hopper receptacle 42 between the guide rails 52,54 so as to pinch the first few cards of the stack of cards. A front end portion 156 of the pinch activation members is angled outwardly at approximately 20 degrees so as to define a barrier for initially engaging the rollers 112.

The suction release valve 66 includes a reciprocal valve stem 160 disposed in a back end of a cylinder 162, the valve stem 160 cooperating with the cylinder 162 to define an air path 158 therethrough upon depression of the valve stem which, in turn, cooperates with air paths 161,163,165 extending through the suction cup block member 120, the threaded member 121, and the suction cup 64, respectively, to a surface 68 of the suction cup 64 facing the card 46. As the suction cup block member 120 is reciprocally moved backward, the valve stem 160 engages a threaded projection 164 of the bearing block 124 so as to cause depression of the valve stem 160 so as to provide air communication between the ambient air and the vacuum formed by the suction cup 64 so as to release the suction force generated at the suction cup 64, whereby the card 46 is released.

Referring now generally to FIGS. 5 through 11, use of the embodiment of the input hopper apparatus 40 shown will now be described. The mechanical operation of the input hopper apparatus 40 can be divided into a pick cycle and a transfer cycle. The pick cycle will separate the card 46 from the stack of cards 44 and position it in the staged position for subsequent transfer. The transfer cycle will transport the card 46 from the staged position to the transfer position in the card transfer path 59. Both of these cycles are driven by the common DC motor 82. In the preferred embodiment, the DC motor 82 rotates counter-clockwise when viewed from the top of the input hopper apparatus 40 to drive the pick cycle and clockwise to drive the transfer cycle.

The one-way pulley/clutch 84 operates during the pick cycle and is disengaged from the drive shaft 81 during operation of the transfer cycle. Similarly, the one-way clutches 86,88 operate during the transfer cycle and are disengaged during the pick cycle.

Figure 13:
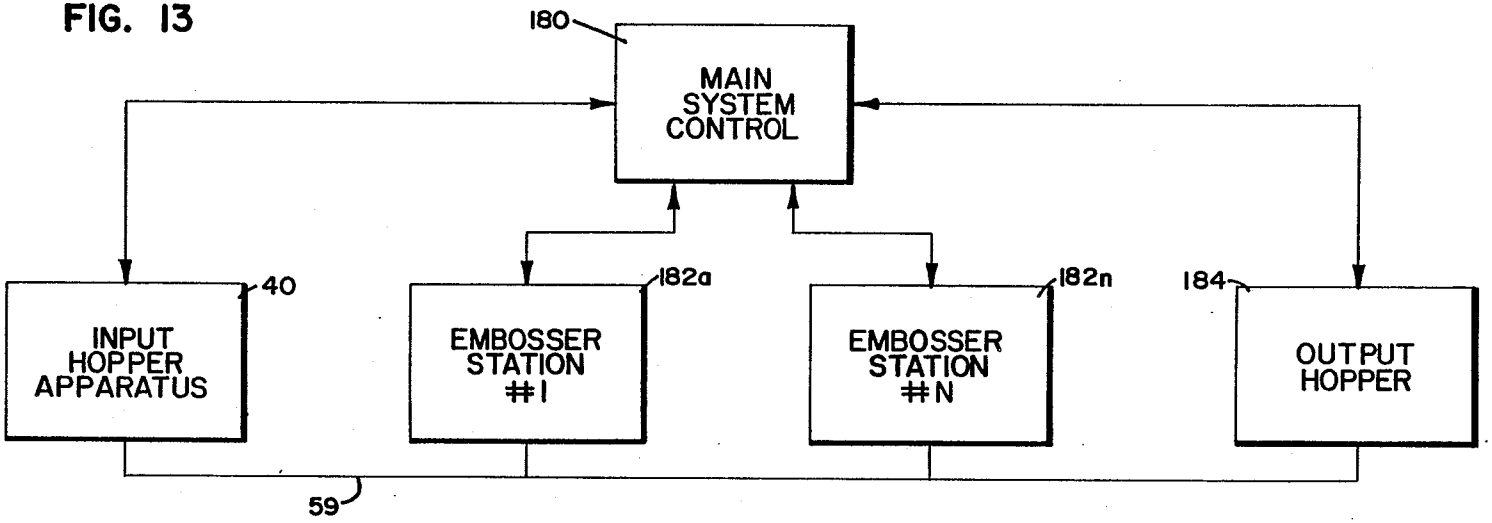
FIG. 13 is a diagrammatic view illustrating use of the input hopper apparatus in an automatic embossing apparatus.

A microprocessor control arrangement 170 including a suitable microprocessor, latch and memory will control operation of the input hopper apparatus 40. The control arrangement 170 will be preferably mounted in close proximity to the input hopper apparatus 40. Typically, when utilized in a particular application, such as an electronic embossing system, the control arrangement 170 will communicate with a system microprocessor control 180 which controls overall operation of the system. A block diagram of an embodiment of an overall system is illustrated in FIG. 13. The system control 180 is illustrated communicating with the input hopper apparatus 40 as well as embosser stations 182*a*, . . . *n* and an output hopper 184. When the control arrangement 170 receives a pick signal from the control 180 indicating that a card is required, the transfer cycle is initiated. When the trailing edge of the card 46 is detected by a mechanical limit switch 172 mounted on the cover 65 over the rollers 72,74 or a 500 millisecond timeout occurs, the transfer cycle is stopped and the pick cycle is started. When the pick cycle is completed; i.e., the switch 80 detects movement of the suction cup assembly 62 into its back position after having detected movement forward to pick a card, the control 170 will await for the next pick signal from the system control 180.

The microprocessor control 170 and its associated memory might be appropriately programmed to attempt the pick cycle twice before a feed error condition is detected, and the user appropriately alerted via audible and/or visual indicator apparatus. It will be appreciated that, per the above discussion, the card 46 is at the staged position as generally illustrated in FIG. 10, while waiting for a pick signal to be received from the system control 180. Accordingly, the present invention provides for a very quick and reliable response to the pick signal. Moreover, the actual picking of a card is done during what would normally be an inactive period of time.

Figure 6:
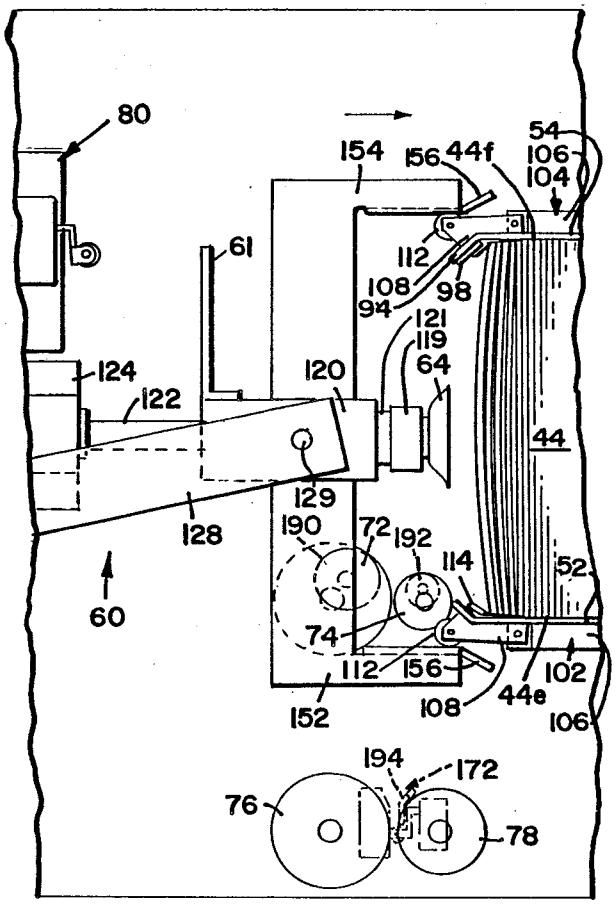
FIG. 6 is a top plan diagrammatic view illustrating the input hopper apparatus in a card pinching state of operation.
Figure 5:
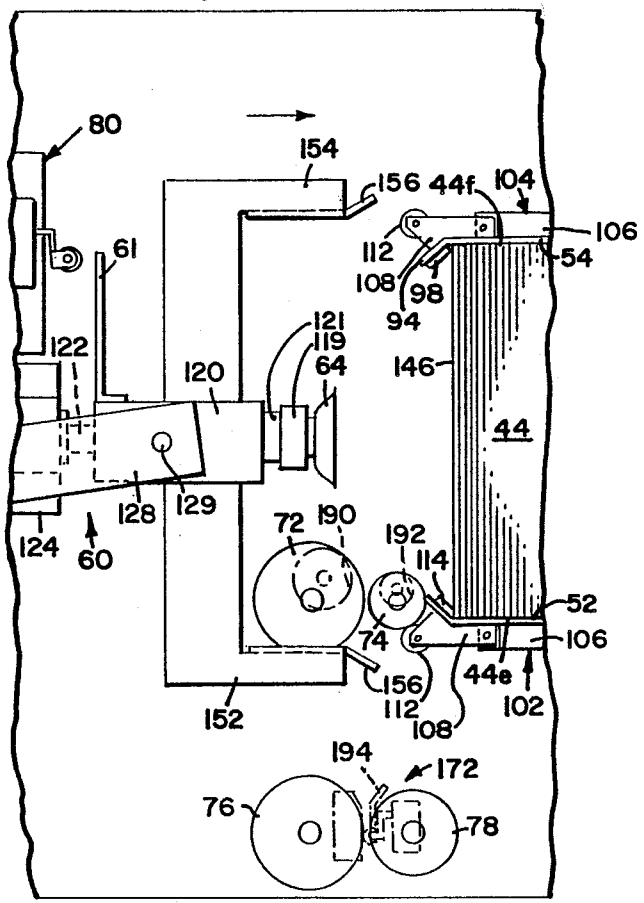
FIG. 5 is a top plan diagrammatic view illustrating the input hopper apparatus in a rest state of operation.

The pick cycle as discussed includes a separating and staging cycle. The separating function of the pick cycle occurs in the pick cycle prior to the staging function. The separating function can be divided into three basic steps: (1) pinch, (2) fan, (3) separate. As the pick cycle begins, the drive arm 126 rotates counter-clockwise driving the pick mechanism 60 forward (toward the front of the system) as generally illustrated in FIGS. 5 and 6. In one embodiment of the invention, the suction cup 64 will travel at a variable speed of 0 to 11.8 inches per second along its path of travel. The card pinch activation members 152,154 attached to the suction cup block member 120, drive the card pinch members 102,104 in toward the leading and trailing sides 44*e,f* of the stack of cards 44. The soft resilient material 114 on the card pinch members 102,104 engages (pinches) the sides 44*e,f* of the cards and slightly bows the first few cards in a direction toward the pick arrangement 60, with most of the force being placed on the first card 46.

Figure 8:
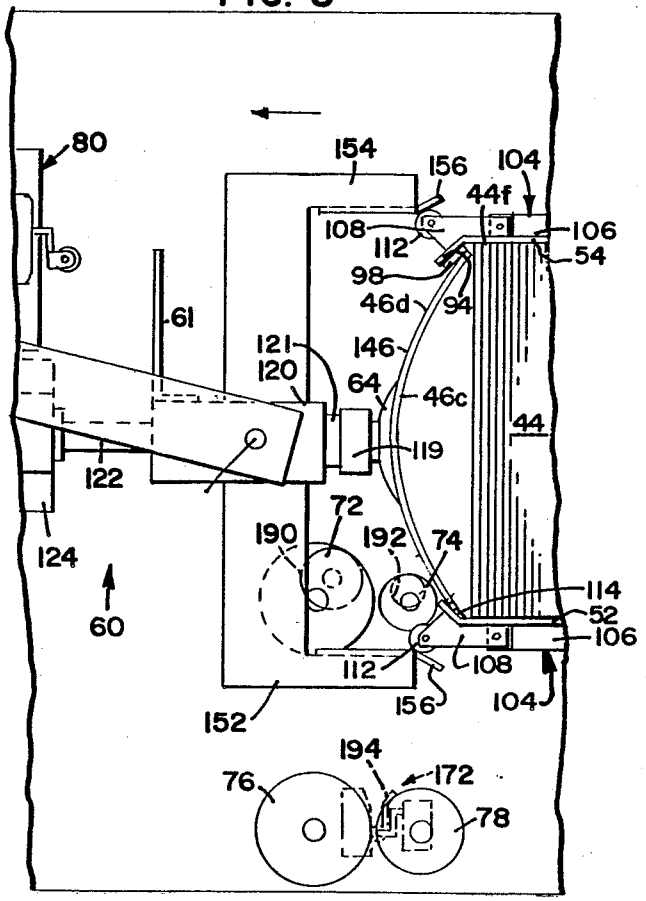
FIG. 8 is a top plan diagrammatic view of the input hopper apparatus in a card separating state of operation.
Figure 7:
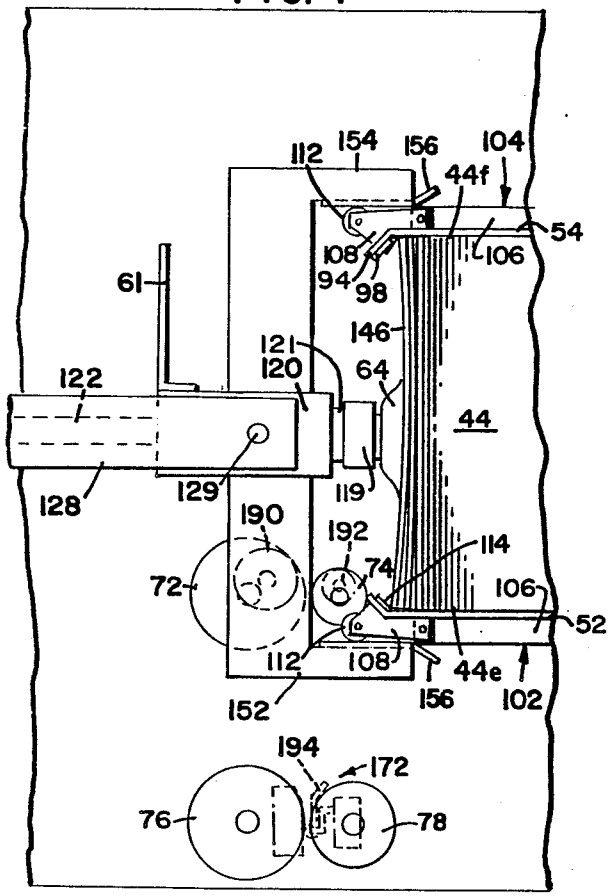
FIG. 7 is a top plan diagrammatic view of the input hopper apparatus in a card fanning state of operation.

After the cards are pinched so as to be somewhat fanned apart, the suction cup 64 forces the first few cards of the stack of cards 44 from the rear bowed condition through a relatively straight or aligned position to a forward bowed condition as generally illustrated in FIG. 7. As the cards are forced into the forward bowed condition, the bending moment in the second, third, etc. cards cause them to separate (fan) from the first card at the sides 44*e,f*. At the end of this fanning process, the pick mechanism 60 is moved completely forward and the air in the suction cup 64 has been forced out through one-way valve 174 in communication with the air path 161 in the suction cup block member 120. This creates a partial vacuum between the suction cup 64 and the back surface 46*d* of the card 46 in contact with the suction cup 64 when a backward force is exerted on the suction cup, whereby the suction cup 62 adheres to the back surface 46*d* of the card 46. In the preferred embodiment of the invention, the suction cup assembly 62 forms its vacuum without the assistance of pumps or other vacuum assist devices. Further, in the embodiment shown, the spring/mass arrangement of the card pusher assembly 97 assures that the force required to move the stack of cards 44 in the forward direction is greater than the force required to collapse the suction cup 64, thereby assuring formation of the partial vacuum. In one application, 1 to $1\frac{1}{4}$ pounds for force will collapse the suction cup 64 which then generates 15 to 20 pounds of force. After the cards have been fanned, the pick mechanism 60 begins moving backward pulling the first card 46 away from the remaining stack of cards through a toggle position to the rear bowed position as is generally illustrated in FIG. 8. A combination of the static charge, vacuum between the cards, friction and inertia provides a force resisting movement of the stack of cards 44 backward so as to prevent the remaining cards from following the first card 46. It will be appreciated that the resistive force and biasing force might be provided in any number of ways. As illustrated in FIG. 8, the pinch activation members 152,154 disengage from the card pinch members 102,104 so as to release the stack of cards 44 and allow the stack of cards 44 to slide backward ready for the next pick cycle. The spring/mass arrangement of the card pusher assembly 97 moves slower toward the back end of the hopper receptacle 42, than the suction cup 64 moves backward, thereby assuring the card 46 is separated from the stack of cards 44.

In the embodiment shown, the card pusher assembly 97, includes a plate 200 and a handle 202 mounted on a carriage 206. The carriage 206 includes rollers 204 for movement over the plate 50. A bracket 208 is attached to the carriage 206 for attachment of the mass 90 and the spring 95.

Figure 9:
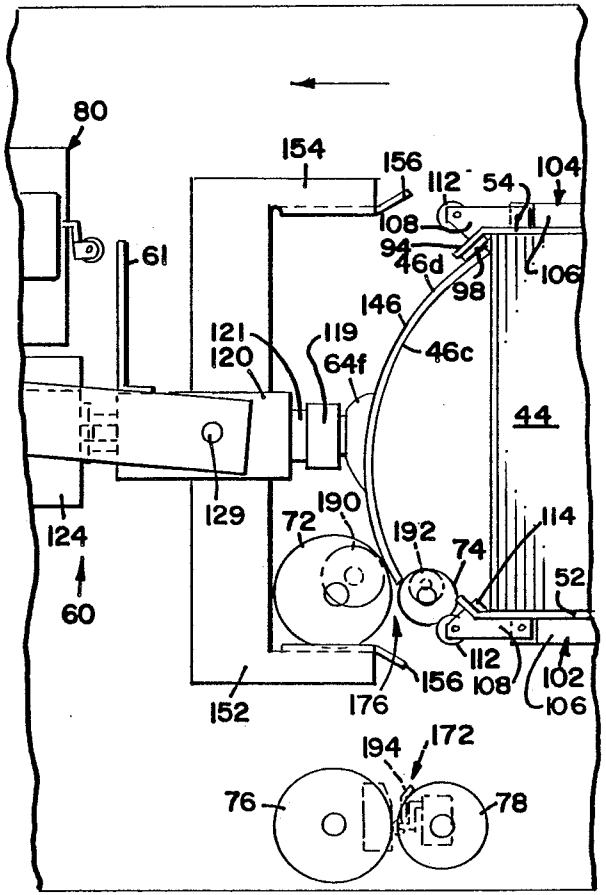
FIG. 9 is a top plan diagrammatic view of the input hopper apparatus in a card removing state of operation.

The staging function includes positioning and releasing the card 46. As the suction cup 62 pulls the card 46 backward, the resilient pad 98 on the trailing rail member 54 increases the drag or resistance on the trailing side 46*f* of the card 46 allowing the leading side 46*e* to be pulled beyond the back end of the rail member 52 while the trailing side 46*f* is still retained within the hopper receptacle 42. The leading side 46*e* is pulled backward to bow around the idler roller 72 until the leading side 46*e* is beyond a nip 176 defined by the rollers 72,74 as generally illustrated in FIG. 9, the roller 72 restricting movement of the side 46*e* of the card 46 in the backward direction. At this time, the rollers 72,74,76,78 are not rotating. Further facilitating removal of the leading side 46*e* from the hopper receptacle 42 is the fact that in the preferred embodiment, the suction cup 64 is offset so as to be closer to the leading side 46*e* of the card 46 than to the trailing side 46*f*.

As the pick mechanism 60 approaches its maximum rear position, the stem 160 of the suction release valve 66 is depressed enabling air flow from the outside ambient air into the area between the suction cup 64 and the card 46 so as to remove the vacuum therebetween and release the card 46. When released, the bowed card straightens out and forces its leading edge 46*e* into the nip 176 as generally illustrated in FIG. 10. The card 46 is now ready to be transferred at the end of the pick cycle, the motor 82 is shut off.

As generally illustrated in FIG. 11, in the transfer cycle the card 46 is transferred from the staged position to a card transfer position on the card transfer path 59. The card 46 is made to move by opposite, cooperating rotation of the opposing rollers 72,74. As the rollers 72,74 begin turning, the card 46 begins moving toward the transfer position. The one-way pulley/clutch 84 is disengaged from the drive shaft 81 of the electric motor 82 at this time so as to allow a spring 178 fixedly mounted at a back end and interconnected to the suction cup block 120 at a front end to maintain the pick mechanism card pinch activation members 152,154 back away from the card path of movement as generally illustrated in FIG. 11. The card 46 is transferred to the output roller set 76,78 on to the card transfer path 59. A guide structure is preferably present to guide movement of the card 46 between the rollers 72,74 and the rollers 76,78. In the embodiment shown, the cover 65, rollers 190,192, and member 194 serve this function. The rollers 190,192 on the cover 65 also facilitate proper staging of the card 46. When the trailing side 46*f* is detected by the switch 172, the transfer cycle is terminated and the pick cycle begins.

The input hopper controller 170 controls operation of the DC motor 82 and communicates card pick status to the main system control 180 which, as discussed, will typically be present for coordinating and controlling the various elements and stations of the application wherein the input hopper apparatus 40 is being utilized. When a card is required, the controller 170 receives a pick signal from the main system control 180. If the card 46 has been picked, or the input hopper apparatus is in the process of picking the card 46, the control 170 will transmit a busy signal. The control 170 controls the direction of the DC motor 82, counter-clockwise for picking the card 46 and clockwise for feeding the card 46. Signals associated with the card pick control process are summarized below:

Pick Signal - The pick signal comes from the main system control (CPU) 180 to command the picking of a card.

Busy Signal - A busy signal is generated at the control 170 in response to a pick signal if a card has already been picked and/or the input hopper apparatus is in the process of picking a card.

Exit Switch - The hall effect limit switch 172 located above the rollers 76, 78 is activated when the card 46 is being transferred. An LED is associated with the switch such that it is on when the exit switch is active.

Home Switch - The home switch 80 is a hall effect limit switch located at the rear of the pick mechanism 60 which is activated when the mechanism is in the pulled back position. The home switch is interconnected to an LED such that the LED is on when the home switch is active.

The general theory of signal operation of one embodiment of the input hopper apparatus 40 will now be described.

Figure 14:
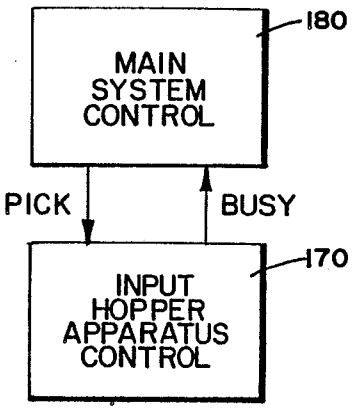
FIG. 14 is a block diagram of the input hopper apparatus control interface with overall system control such as might be present in an automatic embossing apparatus.

The busy signal is set low for power up indicating that the controller 170 is ready to receive a pick signal. When the pick signal goes low (pick signal), the controller apparatus 170 turns the DC motor 82 on in the direction to transfer the card 46 to the transfer position 58 in the card transfer path 59 and the busy signal is set to high so the main system controller 180 is informed that the input hopper apparatus 40 is busy. As the card 46 exits the input hopper 40 on to the card transfer path 59, it will activate the exit switch 172 which causes the busy signal to go low. This informs the main system controller 180 that the card 46 is leaving the input hopper apparatus 40. When the card 46 clears the exit switch 172, the busy is set high again to tell the main system controller 180 the card 46 has left the input hopper apparatus 40 and is in the transfer position on the card transfer path 59. The system controller 180 will acknowledge that the card has exited by sending the pick signal high (card exit signal). The input hopper control 170 upon receipt of the pick signal will reverse the direction of the DC motor 82. Once the card pick mechanism 60 has rotated a cycle and activates the home switch 80 and then deactivates the home switch 80, the DC motor 82 is turned off and the busy signal is set low to indicate to the system control 180 that the input hopper is through picking the card 46. The signal arrangement enables communication between the input hopper control 170 and the system control 180 with only two signal lines, pick and busy as generally illustrated in FIG. 14. In addition, this provides for compatability with older, existing systems.

In one embodiment, the logic sequence and control of the input hopper apparatus 40 is accomplished with an 8031 microprocessor, an address latch, and programmable read only memory. A crystal oscillator will provide the main clock function, the 8031 microprocessor being reset during the power up cycle. The control of the motor circuits is accomplished by the pick signal and the card exit signal.

The motor control circuits are a full bridge configuration for two motor directions. The circuit is preferably a chop mode control for speed control and efficiency. There are two motor control circuits, one for each direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention, to the full extent indicated by the broad general meaning of the terms in which the appended claims are expressed.

What is claimed is:

1. A method for receiving a stack of cards and for individually feeding the cards into a card transfer path, the method comprising the steps of:

(a) receiving a stack of cards in input hopper receptacle means having a first end and a second end;

(b) exerting a force on the stack of cards in a direction toward the second end of the input hopper receptacle means;

(c) pinching opposing edges of at least a first card closest the second end of the input hopper so as to force the opposing edges of at least the first card toward each other, the pinching step being accomplished by reciprocally moving pinch means between a first position wherein the pinch means is pinching opposing edges of at least the first card and a second position wherein the pinch means is not pinching opposing edges of at least the first card;

(d) fanning at least the first card closest the second end of the input hopper receptacle means by forcing suction means into engagement with a major surface of the first card facing away from the stack of cards such that the first card is bowed between its opposing edges in a direction toward the first end of the input hopper receptacle means and such that a suction force is created between the suction means and the first card;

(e) individually separating the first card from the stack of cards by retracting the suction means away from the stack of cards while the suction means is engaged to the first card; and (f) transferring the card to a card transfer path.

2. A method in accordance with claim 1, wherein the step of removing the first card includes the step of forcing a flexible suction cup against the major surface of the first card at the second end of the input hopper receptacle means so as to deform the suction cup.

3. A method in accordance with claim 1, wherein the step of transferring includes the steps of first transferring the card to a staged position and subsequently transferring the card to a transfer position on the card transfer path.

4. An input hopper apparatus for receiving a stack of cards and for individually feeding cards to a card transfer path, individual cards of the stack of cards having first and second major surfaces, the apparatus comprising:

(a) input hopper receptacle means for receiving the stack of cards, the input hopper receptacle means having first and second ends and comprising:

(i) support means for supporting the stack of cards;

(ii) guide rail means for guiding movement of the stack of cards;

(iii) force means for forcing the stack of cards toward the second end;

(b) pick means disposed proximate the second end of the hopper receiving means for individually picking a card from the stack of cards, the pick means comprising pinch means for pinching opposing edges of at least a first card of the stack of cards so as to force opposing edges of at least the first card toward each other and suction means for engaging a major surface of the first card and bowing the first card in a direction generally toward the first end of the input hopper receptacle while the first card is pinched by the pinch means whereby the opposing edges of the first card are separated from those of the other cards in the stack of cards and removing the first card from the stack of cards at the second end of the input hopper receptacle means, the pinch means being reciprocally moveable between a pinching position wherein the pinch means is pinching opposing edges of at least the first card so as to force the opposing edges toward each other and a second position; and (c) transfer means for transferring the card removed from the stack of cards to a card transfer path, whereby the card can then be transferred elsewhere.

5. An apparatus in accordance with claim 4, wherein a single DC motor is used to drive the pick means and the transfer means, control means is provided for reversing the direction of the motor between picking the card and transferring the card.

6. An apparatus in accordance with claim 4, including a drive arrangement including a first one way clutch means for driving the pick means and a second one way clutch means for driving the transfer means.

7. An apparatus in accordance with claim 4, wherein the suction means includes passive suction means having a deformable suction cup, wherein no vacuum source is required to create a partial vacuum between the deformable suction cup and the first card.

8. An apparatus in accordance with claim 4, wherein the pinch means is moved into the pinching position prior to the suction means engaging the first card.

9. An apparatus in accordance with claim 4, wherein the suction means bows the first card partially beyond a plane containing the opposing edges of the first card.

10. An apparatus in accordance with claim 4, wherein the stack of cards has a horizontal orientation.

11. An input hopper apparatus for receiving a stack of cards and for individually feeding cards to a card transfer path, individual cards of the stack of cards having first and second major surfaces, the apparatus comprising:

(a) input hopper receptacle means for receiving the stack of cards, the input hopper receptacle means having first and second ends and comprising:

(i) support means for supporting the stack of cards;

(ii) guide rail means for guiding movement of the stack of cards; and (iii) first force means for forcing the stack of cards toward the second end;

(b) pick means disposed proximate the second end of the hopper receptacle means for individually picking a card from the stack of cards, the pick means comprising:

(i) means for bowing at least a first card at the second end of the input hopper receptacle means in a direction toward the second end of the input hopper receptacle means, the means for bowing including card pinch means proximate the second end of the input hopper receptacle means for forcing toward each other opposing edges of at least the first card; and (ii) suction means reciprocally movable toward and away the stack of cards for engaging a first major surface of the first card facing away from the stack of cards and removing the first card so engaged from the stack of cards, the suction means including a deformable suction cup member and second force means for forcing the suction cup member against the first card and in a direction toward the first end of the input hopper receptacle means so as to bow the first card in a direction toward the first end of the input hopper receptacle means and deform the suction cup member, thereby creating a suction force without necessitating actively withdrawing air from the cavity formed by the suction cup member and the card it engages, the force required to displace the stack of cards toward the first end of the input hopper receptacle means being greater than the force required to deform the suction cup member, the means for bowing including means for activating the card pinch means prior to the suction cup member engaging the surface of the first card at the second end of the input hopper receptacle means, the suction cup cooperating with the card pinch means to fan at least the first card from the stack of cards as the first card is bowed toward the first end of the input hopper receptacle means; and (c) transfer means for transferring the card to the card transfer path, whereby the card can then be transferred elsewhere.

12. An apparatus in accordance with the claim 11, wherein the stack of cards has a substantially horizontal orientation.

13. An apparatus in accordance with claim 11, wherein the guide rail means includes trailing and leading side guide rail members projecting inwardly toward the stack of cards so as to restrict movement of the stack of cards toward the second end of the input hopper receptacle means, the trailing side guide rail member being located on a side of the rail means in a direction away from the card transfer path and providing greater resistance to movement of the stack of cards than the leading side member, thereby allowing a leading edge of the first card to be pulled beyond the leading side guide rail member before a trailing edge of the first card is pulled beyond the trailing side guide rail member.

14. An apparatus in accordance with claim 11, wherein the pick means includes means for placing the card picked from the stack of cards in a staged position for subsequent transfer to the card transfer path.

15. An apparatus in accordance with claim 14, wherein the input hopper apparatus includes means for transferring the card picked from the staged position to the card transfer path.

16. An apparatus in accordance with claim 11, wherein the force means for forcing the cards toward the second end of input hopper receptacle means includes a cooperating mass and spring arrangement.

17. An apparatus in accordance with claim 16, wherein the suction means is reciprocally mounted for movement toward and away from the second end of the input hopper assembly in a direction substantially perpendicular to a major surface of the card at the second end of the input hopper receptacle means.

18. An apparatus in accordance with claim 11, wherein the input hopper means includes force opposing means for limiting the rate of movement of the stack of cards to less than the rate of movement of the suction means away from the second end.

* * * * *

UNITED STATES PATENT AND TRADEMARK OFFICE

CERTIFICATE OF CORRECTION

PATENT NO. : 4,921,237

DATED : May 1, 1990

INVENTOR(S) : Nubson et al.

It is certified that error appears in the above-identified patent and that said Letters Patent is hereby corrected as shown below:

Title page: of Patent, line [63], "Sep. 5, 1987" should read --Sep. 5, 1986.

In Column 1, line 5, "1987" should be --1986--; line 10, insert --.-- after the word "path"; line 22, "patent" should read --patents--.

In Column 12, line 46, insert --from-- after the word "away".

Signed and Sealed this

First Day of June, 1993

*Attest:*

Michael K. Kirk

MICHAEL K. KIRK

*Attesting Officer*

*Acting Commissioner of Patents and Trademarks*